US008550099B2

(12) United States Patent
Essex

(10) Patent No.: US 8,550,099 B2
(45) Date of Patent: Oct. 8, 2013

(54) SUNBRELLA-SUNSCREEN

(76) Inventor: James Ollans Essex, Diamond Bar, CA (US)

( * ) Notice: Subject to any disclaimer, the term of this patent is extended or adjusted under 35 U.S.C. 154(b) by 346 days.

(21) Appl. No.: 12/911,668

(22) Filed: Oct. 25, 2010

(65) Prior Publication Data

US 2011/0099692 A1 May 5, 2011

Related U.S. Application Data

(60) Provisional application No. 61/280,076, filed on Oct. 30, 2009.

(51) Int. Cl.
*A45B 25/18* (2006.01)
*A45B 15/00* (2006.01)
*A45B 3/00* (2006.01)

(52) U.S. Cl.
USPC ..... 135/33.2; 135/16; 135/33.41

(58) Field of Classification Search
USPC ..... 135/15.1, 16, 19.5, 33.2, 33.4, 33.41
See application file for complete search history.

(56) References Cited

U.S. PATENT DOCUMENTS

| | | | | |
|---|---|---|---|---|
| 128,780 | A | 7/1872 | Battle | |
| 317,972 | A | 5/1885 | Cary | |
| 617,415 | A | 1/1899 | Eatman | |
| 1,560,073 | A | 11/1925 | Bontempi et al. | |
| 1,587,681 | A | 6/1926 | Schumacher | |
| 1,706,205 | A | 3/1929 | Alonzo | |
| 1,785,561 | A | 12/1930 | Riley | |
| 2,495,041 | A * | 1/1950 | Weiss | 2/171.01 |
| 2,746,469 | A | 5/1956 | D'Andrea | |
| 2,845,289 | A * | 7/1958 | Cicogna | 2/257 |
| 3,091,249 | A * | 5/1963 | O'Neil | 135/16 |
| 3,456,661 | A | 7/1969 | Farley | |
| 4,312,371 | A * | 1/1982 | Koon | 135/19.5 |
| 4,316,289 | A | 2/1982 | Hild | |
| 4,979,534 | A | 12/1990 | Johnson et al. | |
| 5,065,779 | A | 11/1991 | Johnson et al. | |
| 5,406,645 | A | 4/1995 | Lin et al. | |
| 5,487,401 | A | 1/1996 | Johnson et al. | |
| 5,727,250 | A | 3/1998 | Black | |
| 5,890,506 | A | 4/1999 | Kupferman | |
| 5,899,571 | A * | 5/1999 | Chalk | 383/4 |
| 6,081,922 | A | 7/2000 | Wright | |
| 6,131,591 | A | 10/2000 | Hollah | |

(Continued)

FOREIGN PATENT DOCUMENTS

WO WO 9503724 A1 * 2/1995

*Primary Examiner* — David Dunn
*Assistant Examiner* — Danielle Jackson
(74) *Attorney, Agent, or Firm* — Kirk A. Buhler; Buhler & Associates

(57) ABSTRACT

Improvements in protection with a sunbrella-sunscreen made of a porous, nonporous, non-permeable fabrics such as mesh silver nylon and silver polyester used to protect one from sun rays and precipitating rain. The sunbrella-sunscreen canopy is removable and changeable. The covering can be changed from fabric, material, properties and color(s). The sunscreen can be worn with any head wear, cap, hat, or the user can use a special head wear which is specifically to be worn with the Sunscreen. The sunbrella can further be secured within an umbrella type frame that can be carried like an umbrella. When not used the mechanical apparatus sunbrella is collapsible and foldable to a smaller size to be stored in a small pouch. When not used the mesh sunscreen, the nonporous, non-permeable fabric is collapsible and foldable to a smaller size to be stored in a small pouch.

16 Claims, 4 Drawing Sheets

(56) References Cited

U.S. PATENT DOCUMENTS

| | | | | |
|---|---|---|---|---|
| 6,233,745 | B1 | 5/2001 | Friesen | |
| 6,260,208 | B1 * | 7/2001 | Wang | 2/209.11 |
| 6,390,107 | B1 * | 5/2002 | Lin et al. | 135/25.4 |
| 6,484,323 | B1 * | 11/2002 | Pu | 2/410 |
| 6,758,003 | B2 * | 7/2004 | Zheng | 40/610 |
| 6,996,852 | B1 | 2/2006 | Cabrera | |
| 7,343,630 | B2 | 3/2008 | Lee | |
| D617,539 | S | 6/2010 | Boles | |
| D672,096 | S * | 12/2012 | Bryan et al. | D29/122 |
| 2002/0108645 | A1 * | 8/2002 | Beyer et al. | 135/33.2 |
| 2004/0000332 | A1 * | 1/2004 | Yang | 135/15.1 |
| 2006/0174396 | A1 * | 8/2006 | Rosas | 2/175.6 |

* cited by examiner

SUNBRELLA-SUNSCREEN

CROSS REFERENCE TO RELATED APPLICATION

This application claims the benefit of Provisional 61/280,076 filed Oct. 30, 2009 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to improvements in a sunshade. More particularly, the present sunbrella-sunscreen is constructed from a fabric mesh that can be installed either over and around an existing hat or on an umbrella type holding mechanism to create a permeable or impermiable shade through which air may pass and also protect people from UV sun rays.

2. Description of Related Art Including Information Disclosed Under 37 CFR 1.97 and 1.98

Protection from the elements of sun and rain has long been desirable. The sun produces harmful UV rays that are harmful to exposed skin. The heat from the sun can also make a person uncomfortable. In some cases full blocking of sunlight is preferred, but full blocking of the sun also blocks air movement. A better approach is to use a mesh product that blocks the majority of sunlight and also allows air movement. A person can wear a hat to block some sunlight, but in most cases the brim of a hat is often not large enough to provide the desired amount of UV protection.

For people that don't wear hats, protection from the sun can take the form of a sunbrella where the sunbrella can be made from a mesh product that provides both shade and air movement. A nonporous attachment can also be added to the sunbrella to provide protection from rain. Several products and patents have been issued that try to address some of these issues, but no patents cover all of the features, functions and benefits that are claimed in this application exist. Exemplary examples of patents covering some of these features are found in the disclosed references herein.

U.S. Pat. No. 4,316,289 issued Feb. 23, 1982 to Melvin O. Hild discloses a sun shield for a hard hat. The sun shield is a hard relatively thick, generally oval piece of rigid plastic with a central aperture where a hard hat can be placed through the central aperture. Because this sun shield is made from a hard piece of plastic it does not provide for air movement through the sun shield and is difficult to store in a pocket because it is not flexible.

U.S. Pat. No. 1,587,681 issued Jun. 8, 1926 to L. F. Schumacher, U.S. Pat. No. 5,727,250 issued Mar. 17, 1998 to Randolph Black and U.S. Pat. No. D617, 539 issued Jun. 15, 2010 to Dennis Boles all disclose covers for hats. The covers are essentially flat material with a central hole that fits over a hat. They extend over the size of the brim of a hat to enlarge the shade or rain protection area. While these patents disclose devices that extend the shading brim of a hat they are not convertible into an umbrella to provide protection when a person is not wearing a hat.

U.S. Pat. No. 5,487,401 issued on Jan. 30, 1996, U.S. Pat. No. 5,065,779 issued Nov. 19, 1991 and U.S. Pat. No. 4,979,534 issued Dec. 25, 1990 all to Gary D. Johnson et al., disclose a Windproof Umbrella. The umbrella includes a two piece cover with air holes in the lower cover to allow wind to pass from under the umbrella and out between the outer cover. These patents disclose an umbrella with multiple covers, but the pieces are not interchangeable with a sun protection cover for a hat.

U.S. Pat. No. 5,890,506 issued Apr. 6, 1999 to Glenn Kupferman discloses an umbrella and an umbrella canopy. The underlying umbrella has a central mesh area that allows air to pass through the mesh area. A second canopy umbrella can be temporally secured over the mesh area to provide additional sun protection but also allow venting of air from under the umbrella. While this patent discloses a multi-piece umbrella cover it does not disclose using the pieces as a sun shade for a hat.

What is needed is a sunscreen that can be temporally placed over a hat and also can be secured to an umbrella spindle and arms to create additional protection from the sun and elements.

BRIEF SUMMARY OF THE INVENTION

It is an object of the sunbrella-sunscreen to have a covering of mesh fabric or solid permeable material that allows for the passage of water vapor but not water drops. The sunbrella-sunscreen can also be made of nonporous, non-permeable fabrics such as silver nylon and silver polyester which may be used to protect one from the UV rays of the sun by reflecting as well as protecting one from precipitating rain. Because the covering of the sunscreen is removable and changeable the material that the covering is made from can be changed both from the properties of the fabric and the colors of the fabric.

It is another object of the sunbrella-sunscreen to include a central shank with extendable arms that extend to capture and spread the sunscreen as an umbrella to provide protection from the sun and or other environmental factors. The purpose/function is to hold and secure a sunscreen in place. In doing so, the sunbrella-sunscreen is made whole or a complete entity, system. Containing all elements or component parts to yield a complete and functional system. A mechanical apparatus, when combined with a sunscreen constitutes the whole of the sunbrella-sunscreen. The sunbrella-sunscreen may be used as a unit, when the mechanical apparatus and sunscreen are combined as one.

It is another object of the sunbrella-sunscreen that when disassembled, the sunscreen can be used alone. The sunscreen can be worn with any head wear, cap, hat, etc. or the user can choose to use the sunscreen special head wear which is a cap designed specifically to be worn with the sunscreen.

It is still another object of the sunbrella-sunscreen for the cap to be made of mildly stiff, porous, mesh material/fabric that is collapsible and foldable to a smaller size to be stored in a small pouch.

Various objects, features, aspects, and advantages of the present sunbrella-sunscreen will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
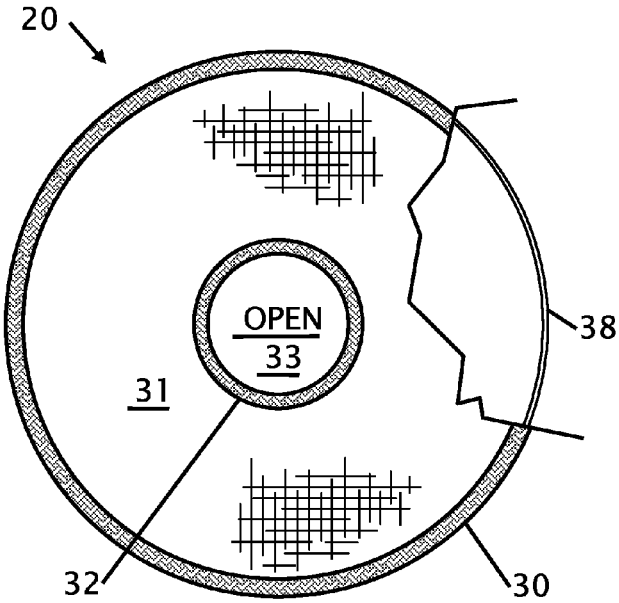
FIG. 1 shows a top view of the sunscreen in an open configuration.

FIG. 1 shows a top view of the sunscreen or sunshade in an open configuration. This figure shows the basic shape and structure of the sunshade portion of the sunshade 20. The sunscreen 31 is made of a mesh fabric which are porous, permeable, through which air may pass, yet protect people from the suns UV rays. It is also contemplated that the sunscreen 31 can be made of nonporous, non-permeable fabrics such as silver nylon and silver polyester which may be used to protect one from the UV rays of the sun by reflecting as well as protecting one from precipitating rain.

The sunscreen is made of material and fabric such as mesh, polyester, nylon or another suitable material. The mesh or nylon material is attached to flat steel wire a flexible metal band 38, which is a round closed plane figure, circle, and loop. The flat steel wire possesses qualities of hardened, flexibility, strength, and elasticity. Depending upon the properties of the flat metal wire, one or more loops will be used to create the desired structural strength and stiffness. The sunscreen 20 has an outer band 30 supported with a flexible metal band 38 located within the outer band 30. An inner band 32 is sized to fit around the top of a head placed within the central open hole 33. A flexible fabric covering sunscreen 31 exists between the outer band 30 and said inner band 32. The outer band 30, inner band 32 and the flexible fabric covering sunscreen 31 are configured to fit over a head covering to provide shade. The inner band 32 of sunscreen is an open hole 33. The open hole 33 has a circumference which is flexible, with fabric or material made elastic, capable of returning to its original shape after being stretched. Flexible, fabric/material, made elastic, as with strips of rubber etc. The flexible material, inner circle, is held in place by being attached at all points to the mesh or nylon material, of which sunscreen is made. The outer band 30, inner band 32 and the flexible fabric sunscreen 31 covering are sewn, glued or bonded together.

Figure 2:
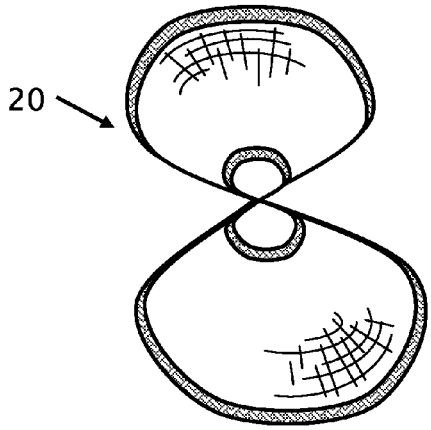
FIG. 2 shows a top view of the sunshade from FIG. 1 as the sunshade is being twist folded.
Figure 3:
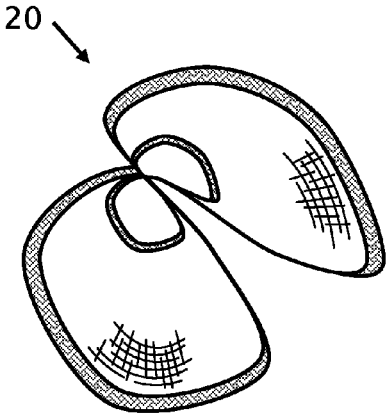
FIG. 3 shows the sunshade from FIG. 2 being folded over.
Figure 4:
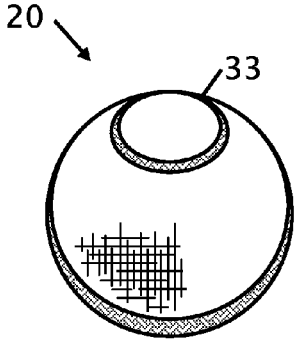
FIG. 4 shows the sunshade from FIG. 3 completely folded.

FIG. 2 shows a top view of the sunshade 20 sunscreen from FIG. 1 as the sunshade 20 is being twist folded, FIG. 3 shows the sunshade 20 from FIG. 2 being folded over and FIG. 4 shows the sunshade 20 from FIG. 3 completely folded leaving the open central hole 33 available to easily hold the folded sunscreen or hold it folded. The folded sunscreen can then be easily stored in a purse or storage container or pouch as shown in FIG. 5.

Figure 5:
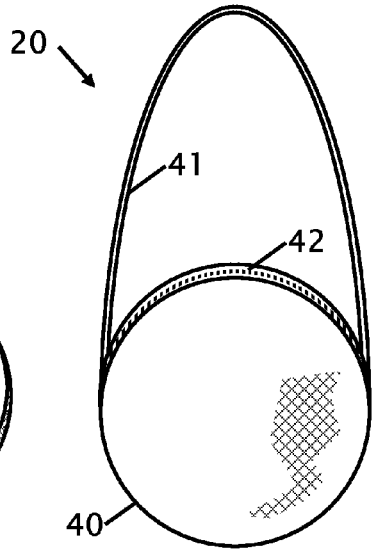
FIG. 5 shows the twist folded sunshade in a storage pouch.
Figure 6:
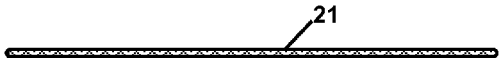
FIG. 6 shows a side view of a sunshade in a flat orientation.
Figure 7:
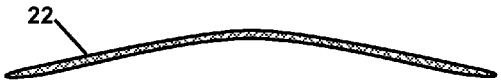
FIG. 7 shows a side view of a sunshade in a curved or arched orientation.

FIG. 5 shows the twist folded sunshade 20 in a storage pouch. The pouch 40 has a top opening 42 to allow for easy insertion and removal of the sunshade so it can be carried in a compacted size. The storage pouch can have a carrying strap of shoulder strap 41 to make transportation easier or hands free. FIG. 6 shows a side view of a sunshade in a flat 21 orientation and FIG. 7 shows a side view of a sunshade in a curved or arched 22 orientation.

Figure 8:
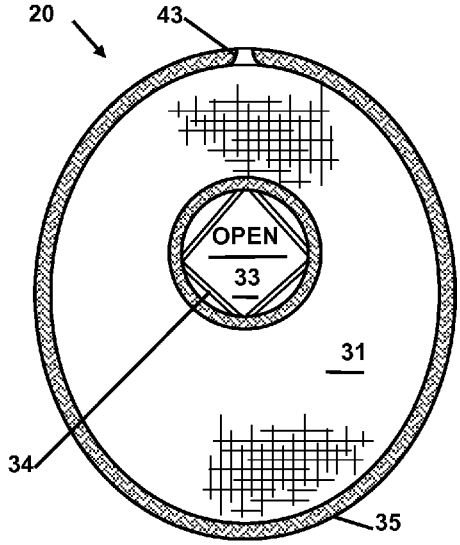
FIG. 8 shows a sunshade where the inner band is offset from the outer band.

FIG. 8 shows a sunshade where the inner band 32 is offset from the outer band 35. The sunshade in this embodiment is offset to allow for more sun protection one side where the sun is shining. The inner band 33 has a plurality of flexible members 34 that grip the outside of a hat or head to accommodate hats or heads of different sizes. The sunshade in this embodiment, is configured to also protect the user from rain. The outer band 35 has a raised outer edge to direct any water that collects on top of the outer band and the fabric top covering sunscreen 31 out a drain passage 43 on the back side of the sunshade 20.

Figure 9:
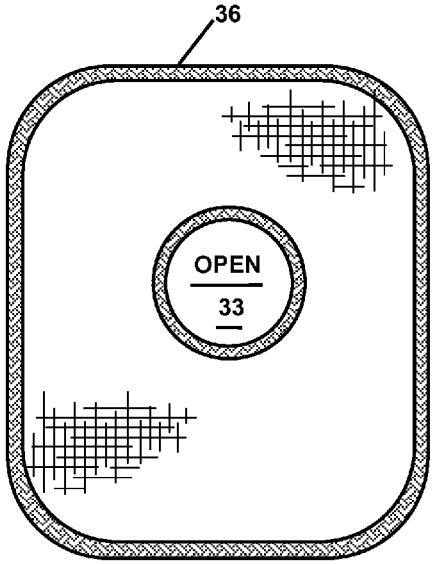
FIG. 9 shows a sunshade as a rounded rectangle.
Figure 10:
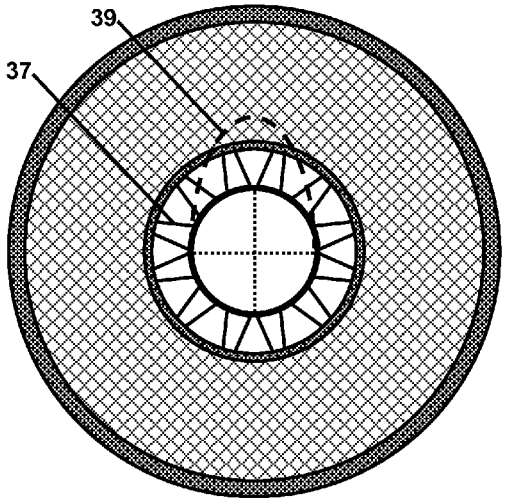
FIG. 10 shows a sunshade with a flexible inner hat retention mechanism.

FIG. 9 shows a sunshade as a rounded rectangle 36 and FIG. 10 shows a sunshade with a flexible 37 inner hat retention mechanism. When disassembled, the sunscreen can be used alone. Sunscreen can be worn with nearly any type of head wear such as but not limited to caps, hats or helmets. The user may choose to use the sunscreen with a special head wear 39. The specialty head wear 39 is designed specifically to be worn with the sunscreen. The special head wear is a cap 39 that is made of mildly stiff, porous, mesh material/fabric that is collapsible and foldable to a smaller size to be stored in the small pouch that is shown and described in FIG. 5.

Figure 11:
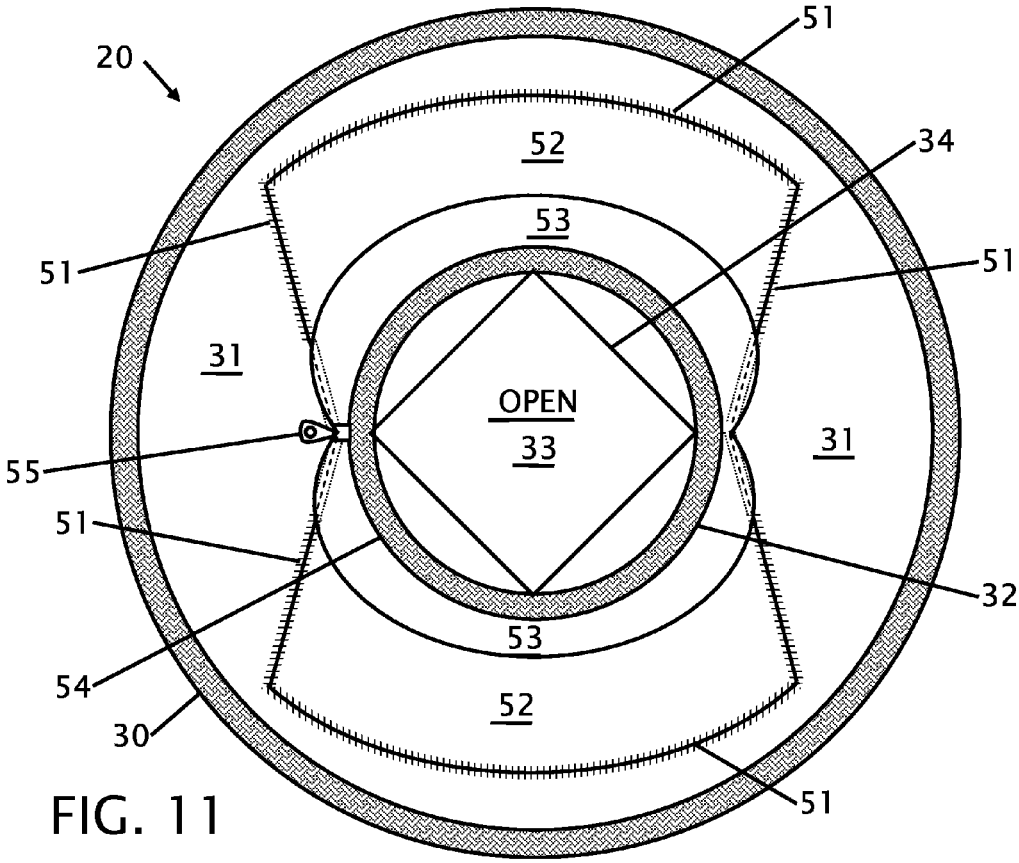
FIG. 11 shows a sunshade with a separating zipper that securable to a sunscreen-rainscreen.
Figure 12:
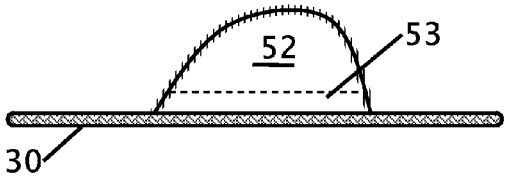
FIG. 12 shows a side view of the sunscreen-rainscreen when the two sides are zipped together.

From FIG. 11 the sunbrella-sunscreen 20 has an outer band 30, an inner band 32 that is sized to fit around the top of a head placed within the central open hole 33. A flexible fabric covering sunscreen 31 exists between the outer band 30 and said inner band 32. The outer band 30, inner band 32 and the flexible fabric covering sunscreen 31 are configured to fit over a head covering to provide shade. Within the inner band 32 of the sunscreen is an open hole 33. The open hole 33 has a circumference which is flexible, with fabric or material made elastic 34, that is capable of returning to its original shape after being stretched. A separating zipper 51 allows the fabric 52 to be opened or zipped closed together as shown in FIG. 12. Nonporous, non-permeable fabric 52 rolls or folds to fit under the inner rim 53 where it is shown in its folded open position. The fabric 53 is made from a non-permeable fabric that has hook and loop fasteners that are located around its under outer edge. Rim 54 has corresponding hook and loop fasteners around its outer edge. When the inner fabric 52 is fully open and fully zipped, the inner ring 52 will cover the inner circle of the non-permeable sunscreen and any head gear. The inner rim 53 is a flap that is sewn to the inner edge of the inner band 32.

Figure 13:
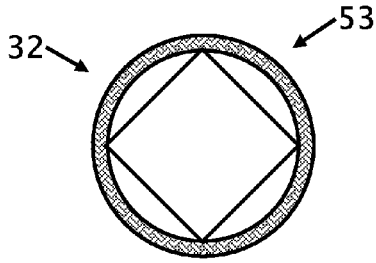
FIG. 13 shows a top view when the inner ring is folded/rolled down.

FIG. 12 shows a side view of the sunscreen-rainscreen when the two sides 52 are zipped together and FIG. 13 shows a top view when the inner ring 52 is folded/rolled down and is under the flap/cover 53. When the sunscreen-rainscreen is in the position shown in FIG. 13 the sunbrella zipper generally mimics the cover of the inner band 32.

Figure 14:
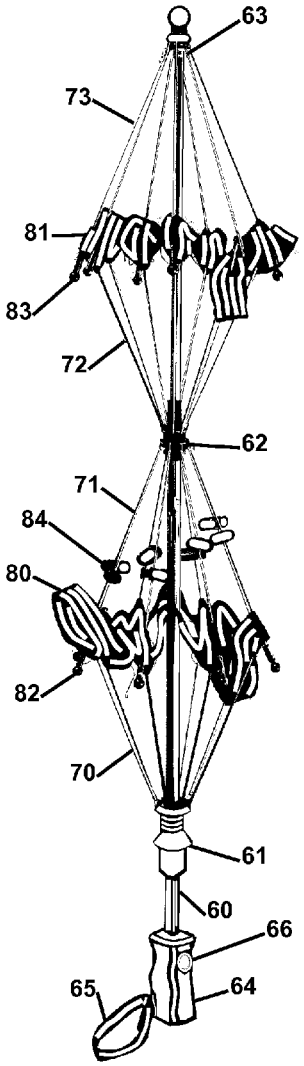
FIG. 14 shows the umbrella like frame structure without the sunscreen installed.
Figure 15:
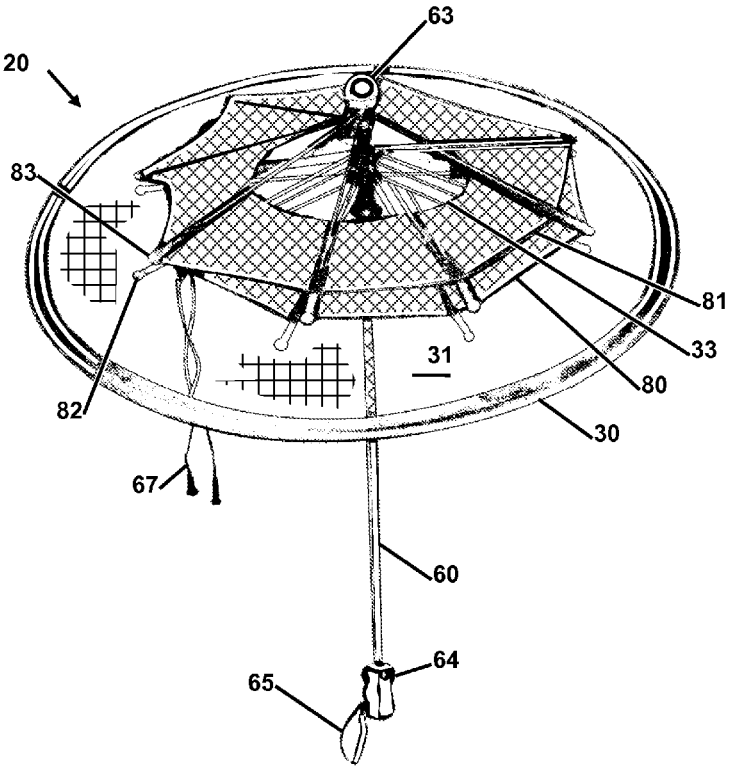
FIG. 15 shows the sunbrella frame with the sunscreen installed.

FIG. 14 shows the umbrella like frame structure without the sunscreen installed. The sunbrella/mechanical apparatus is a fundamental and essential part of the whole sunbrella-sunscreen 20. A device devised and designed for a particular purpose. The purpose/function is to hold and secure a sunscreen in place. In doing so, the sunbrella-sunscreen 20 is made whole or a complete entity, system when the umbrella frame and sunscreen are combined as one as shown in FIG. 15 that shows the umbrella frame with the sunscreen installed.

The whole complete composition of the sunbrella-sunscreen is greater than the sum of its parts. The sunbrella mechanical apparatus has a telescoping handle 60 that slides inward or outward in overlapping sections, as the cylindrical sections of a small hand telescope. A handle 64 with a wrist strap 65 allows a person to more easily grasp the central shaft or telescoping handle 60. A button 66 located in the handle 64 can be used to release the telescope handle 60 thereby making the handle 60 expand by pushing up on sleeve 61 towards stop 62. Pushing up on sleeve 61 and down on the end stop 63 will push the upper tube into the lower tube where they pinch together at the central stop 62.

Attached to the handle 60 of the sunbrella are two symmetrical shapes of expandable ribs 70, 71, 72 and 73 that can collapse and expand to temporally capture the sunshade 20 between the two sets of expandable ribs 70-73. To form a sunshade umbrella or sunbrella. Fabric members 80 and 81 retain the expanding ribs from over extending and they further help to maintain the sunshade 20 between the two sets of expandable ribs 70-73 as shown in FIG. 15. The ends of the ribs 71 and 73 have caps 82 and 83 respectively to prevent damage to the inner fabric field sunscreen 31 of the sunshade 20. The expandable ribs 70-73 function in like/identical manner. They are arranged of like parts that oppose one another. The expandable ribs 70-73 are on opposite side of a boundary telescoping handle and at equal distance from the outer end 30 to the inner ends 33 of the sunscreen 20. A plurality of stays 84 that are located on some of the expandable ribs 71 and are located to sit within the central hole 33 of the sunshade to maintain the sunshade centered within the expandable ribs 70-73. The symmetrical shapes contract/collapse, shortens when supporting and securing the sunscreen as shown in FIG. 15. Drawstrings 67 can be used to control the opening of sunbrella's canopy. Drawstrings 67 are also used as an alternative to control the opening of the sunscreens.

Thus, specific embodiments of a sunbrella-sunshade have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A sunbrella-sunscreen comprising:

an outer band supported with a flexible metal band located within said outer band;

an inner band sized to fit around the top of a head;

a flexible fabric covering that exists between said outer band and said inner band;

wherein said outer band, said inner band and said flexible fabric covering are configured to fit over a head or head covering to provide shade;

said outer band has a raised outer edge to direct any water that collects on top of said flexible fabric covering out a drain passage;

a central shaft that supports two sets of expandable ribs such that said outer band, said inner band and said flexible fabric covering can be placed onto said central shaft through said inner band, and said two sets of ribs can be expanded to temporally capture said outer band, said inner band and said flexible fabric covering between said two sets of ribs to create a sunbrella.

2. The sunbrella-sunscreen according to claim 1 wherein said flexible metal band is flat spring metal.

3. The sunbrella-sunscreen according to claim 1 wherein said outer band, said inner band and said flexible fabric covering can be twisted folded into a smaller size.

4. The sunbrella-sunscreen according to claim 3 wherein said twist folded size is storable in a purse or pouch.

5. The sunbrella-sunscreen according to claim 1 wherein said outer band is made from flexible fabric.

6. The sunbrella-sunscreen according to claim 1 wherein said inner band is made from flexible fabric.

7. The sunbrella-sunscreen according to claim 1 wherein said flexible fabric covering is made from a porous fabric that allows for a passage of air but limited passage of sunlight.

8. The sunbrella-sunscreen according to claim 1 wherein said flexible fabric covering is a nonporous fabric material that reflects sun rays and or repels rain.

9. The sunbrella-sunscreen according to claim 8 wherein said nonporous fabric material is silver nylon or silver polyester.

10. The sunbrella-sunscreen according to claim 1 wherein said outer band, said inner band and said flexible fabric covering is flat, curved or bowed.

11. The sunbrella-sunscreen according to claim 1 wherein said outer band is round, elliptical, square, rectangular or rounded rectangular.

12. The sunbrella-sunscreen according to claim 1 wherein said inner band is centered within said outer band.

13. The sunbrella-sunscreen according to claim 1 wherein said inner band is offset within said outer band.

14. The sunbrella-sunscreen according to claim 1 wherein said outer band, said inner band and said flexible fabric covering are sewn, glued or bonded together.

15. The sunbrella-sunscreen according to claim 1 wherein said two sets of ribs further include stays that maintain said inner band essentially concentric with said central shaft.

16. The sunbrella-sunscreen according to claim 1 wherein said central shaft has telescoping sections that slides inward or outward.

* * * * *